US007918023B2

(12) United States Patent
Sausse et al.

(10) Patent No.: US 7,918,023 B2
(45) Date of Patent: Apr. 5, 2011

(54) METHOD FOR MANUFACTURING A VARIABLE-VANE MECHANISM FOR A TURBOCHARGER

(75) Inventors: Lorrain Sausse, Charmes (FR); Eric Boucher, Rambervillers (FR); Pierre Barthelet, Remiremont (FR); Olivier Espasa, Dogneville (FR); Emmanuel Séverin, Thaon les Vosges (FR)

(73) Assignee: Honeywell International Inc., Morristown, NJ (US)

( * ) Notice: Subject to any disclaimer, the term of this patent is extended or adjusted under 35 U.S.C. 154(b) by 986 days.

(21) Appl. No.: 11/672,804

(22) Filed: Feb. 8, 2007

(65) Prior Publication Data

US 2008/0193281 A1 Aug. 14, 2008

(51) Int. Cl.
*B21K 25/00* (2006.01)

(52) U.S. Cl. ..... 29/889.2; 415/159

(58) Field of Classification Search ..... 29/889.2; 415/159–164, 158; 60/602
See application file for complete search history.

(56) References Cited

U.S. PATENT DOCUMENTS

| | | | | |
|---|---|---|---|---|
| 3,754,833 | A * | 8/1973 | Remberg | 415/108 |
| 4,654,941 | A * | 4/1987 | Burdette et al. | 29/889.22 |
| 4,657,476 | A * | 4/1987 | Berg | 415/48 |
| 4,734,009 | A * | 3/1988 | Campbell et al. | 415/229 |
| 4,804,316 | A * | 2/1989 | Fleury | 417/407 |
| 5,207,565 | A * | 5/1993 | Roessler | 417/407 |
| 6,402,468 | B1 * | 6/2002 | Florin et al. | 415/214.1 |
| 6,883,224 | B2 * | 4/2005 | Thomas | 29/559 |
| 6,916,153 | B2 * | 7/2005 | Boening | 415/163 |
| 7,273,348 | B2 * | 9/2007 | Amirtharajah et al. | 415/214.1 |
| 7,303,370 | B2 * | 12/2007 | Metz et al. | 415/150 |
| 7,322,791 | B2 * | 1/2008 | Stilgenbauer | 415/164 |
| 7,431,560 | B2 * | 10/2008 | Sterner | 415/164 |
| 2002/0119042 | A1 * | 8/2002 | Yoshimura et al. | 415/164 |
| 2006/0062663 | A1 * | 3/2006 | Figura et al. | 415/160 |
| 2006/0140751 | A1 * | 6/2006 | Boening et al. | 415/160 |
| 2008/0031728 | A1 * | 2/2008 | Sausse et al. | 415/160 |

FOREIGN PATENT DOCUMENTS

| | | |
|---|---|---|
| DE | 102004023281 | 1/2005 |
| EP | 1528225 B1 | 10/2003 |
| EP | 1642009 B1 | 5/2004 |
| EP | 11635040 | 9/2004 |
| EP | 1676980 | 12/2004 |
| EP | 1734231 | 6/2005 |

OTHER PUBLICATIONS

PCT/ISR-WO PCT/US2008/053116.

* cited by examiner

*Primary Examiner* — David P Bryant
*Assistant Examiner* — Jacob J Cigna
(74) *Attorney, Agent, or Firm* — Alston & Bird LLP

(57) ABSTRACT

A variable-vane cartridge mechanism for a turbocharger is assembled from a nozzle ring, an insert that engages a turbine housing bore, and a plurality of spacers. Holes larger in diameter than the spacers are formed in the nozzle ring and a nozzle portion of the insert, such that the spacers fit loosely in the holes. A locating fixture is engaged with the nozzle ring and insert for precisely locating these parts radially (and optionally also axially) with respect to each other; the spacers can move within the holes as needed to allow the positions of the parts to be adjusted. Once located relative to each other, the nozzle ring and insert are fixed in the desired relative positions by affixing the spacers to them, such as by welding.

19 Claims, 7 Drawing Sheets

METHOD FOR MANUFACTURING A VARIABLE-VANE MECHANISM FOR A TURBOCHARGER

BACKGROUND OF THE INVENTION

The present disclosure relates to turbochargers having an array of variable vanes in the turbine nozzle for regulating exhaust gas flow into the turbine.

An exhaust gas-driven turbocharger is a device used in conjunction with an internal combustion engine for increasing the power output of the engine by compressing the air that is delivered to the engine's air intake to be mixed with fuel and burned in the engine. A turbocharger comprises a compressor wheel mounted on one end of a shaft in a compressor housing and a turbine wheel mounted on the other end of the shaft in a turbine housing. Typically the turbine housing is formed separately from the compressor housing, and there is a center housing connected between the turbine and compressor housings for containing bearings for the shaft. The turbine housing defines a generally annular chamber that surrounds the turbine wheel and that receives exhaust gas from the engine. The turbine assembly includes a nozzle that leads from the chamber into the turbine wheel. The exhaust gas flows from the chamber through the nozzle to the turbine wheel and the turbine wheel is driven by the exhaust gas. The turbine thus extracts power from the exhaust gas and drives the compressor. The compressor receives ambient air through an inlet of the compressor housing and the air is compressed by the compressor wheel and is then discharged from the housing to the engine air intake.

One of the challenges in boosting engine performance with a turbocharger is achieving a desired amount of engine power output throughout the entire operating range of the engine. It has been found that this objective is often not readily attainable with a fixed-geometry turbocharger, and hence variable-geometry turbochargers have been developed with the objective of providing a greater degree of control over the amount of boost provided by the turbocharger. One type of variable-geometry turbocharger is the variable-nozzle turbocharger (VNT), which includes an array of variable vanes in the turbine nozzle. The vanes are pivotally mounted in the nozzle and are connected to a mechanism that enables the setting angles of the vanes to be varied. Changing the setting angles of the vanes has the effect of changing the effective flow area in the turbine nozzle, and thus the flow of exhaust gas to the turbine wheel can be regulated by controlling the vane positions. In this manner, the power output of the turbine can be regulated, which allows engine power output to be controlled to a greater extent than is generally possible with a fixed-geometry turbocharger.

The variable vane mechanism is relatively complicated and thus presents a challenge in terms of assembly of the turbocharger. Furthermore, the mechanism is located between the turbine housing, which gets quite hot because of its exposure to exhaust gases, and the center housing, which is at a much lower temperature than the turbine housing. Accordingly, the variable vane mechanism is subject to thermal stresses because of this temperature gradient.

To address these issues, the assignee of the present application has developed a variable nozzle "cartridge" design that simplifies the manufacture and assembly of the variable-vane mechanism, as described in co-pending commonly assigned International Patent Application PCT/US05/37622. The cartridge is connected between the center housing and the turbine housing and comprises an assembly of a generally annular nozzle ring and an array of vanes circumferentially spaced about the nozzle ring and disposed in the nozzle such that exhaust gas flows between the vanes to the turbine wheel, each vane being rotatably mounted to the nozzle ring and connected to a rotatable actuator ring such that rotation of the actuator ring rotates the vanes for regulating exhaust gas flow to the turbine wheel. The cartridge includes an insert having a tubular portion sealingly received into the bore of the turbine housing and having a nozzle portion extending generally radially out from one end of the tubular portion, the nozzle portion being axially spaced from the nozzle ring such that the vanes extend between the nozzle ring and the nozzle portion. A plurality of spacers are connected between the nozzle portion of the insert and the nozzle ring for securing the nozzle ring to the insert and maintaining an axial spacing between the nozzle portion of the insert and the nozzle ring.

While the cartridge design generally achieves the objective of simplifying the manufacture and assembly of the variable-vane mechanism, it presents its own challenges. In particular, it is important for the insert and the nozzle ring to be substantially coaxial or concentric with each other, but achieving such concentricity in practice can be difficult. The objective can be achieved by manufacturing all of the component parts of the cartridge with very small dimensional tolerances, but this increases the manufacturing cost considerably.

BRIEF SUMMARY OF THE DISCLOSURE

The present disclosure concerns a method for manufacturing a variable-vane mechanism for a turbine of a turbocharger as generally described above, which aids in achieving the desired concentricity between the insert and nozzle ring in a way that allows relatively large tolerances to be used for the component parts. In this manner, the manufacturing cost can be kept relatively low while still attaining a small tolerance on concentricity. In accordance with one aspect of the present disclosure, a method for manufacturing a variable-vane mechanism for a variable-geometry turbine of a turbocharger comprises the steps of:

(a) providing components for a variable-vane cartridge including a generally annular nozzle ring for supporting an array of vanes circumferentially spaced about a central axis of the nozzle ring, an insert having a tubular portion for being sealingly received into a bore of a turbine housing and having a nozzle portion extending generally radially out from one end of the tubular portion, the insert having a central axis, and a plurality of spacers for extending between and connecting the nozzle portion of the insert and the nozzle ring;

(b) forming a plurality of circumferentially spaced first holes through the nozzle ring for respectively receiving first portions of the spacers, the first portions of the spacers fitting loosely in the first holes;

(c) forming a plurality of circumferentially spaced second holes through the nozzle portion of the insert for respectively receiving second portions of the spacers, the second portions of the spacers fitting loosely in the second holes;

(d) assembling the cartridge by inserting the spacers into the first and second holes;

(e) engaging the cartridge with a locating fixture to adjust relative radial positioning of the nozzle ring and the insert such that the center axes of the nozzle ring and the insert have a desired positional relationship, the spacers moving radially within the first and second holes as necessary to allow the relative radial positioning of the nozzle ring and insert to be established by the fixture; and (f) securing the spacers to the nozzle ring and the insert to fix the nozzle ring and the insert in the relative radial positioning established by the fixture.

In one embodiment, opposite ends of the spacers project beyond outer faces of the nozzle ring and the insert, and step (f) comprises welding the opposite ends of the spacers to the outer faces. Various welding techniques can be employed, including but not limited to laser welding, plasma welding, and electric (arc) welding.

In one embodiment, step (e) comprises engaging a radially inwardly facing surface of the insert with a radially outwardly facing first surface of the fixture, and engaging a radially inwardly facing surface of the nozzle ring with a radially outwardly facing second surface of the fixture. For example, the surface of the insert can comprise the radially inner surface of the tubular portion of the insert, which advantageously can be a circular cylindrical surface. The surface of the nozzle ring can comprise a circular cylindrical locating surface of the nozzle ring that is used for radially locating the nozzle ring within the turbocharger.

The method makes it possible to employ relatively low-precision processes for forming the holes in the nozzle ring and insert and for manufacturing the spacers. Although the nozzle ring and insert each must have a locating surface that is formed with relatively precise dimensions, such surfaces are easily formed, such as by machining on a lathe or the like. Accordingly, the method further simplifies the manufacture of the variable-vane cartridge with precise relative positioning of the nozzle ring and insert.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE DRAWINGS

The present inventions now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1A:
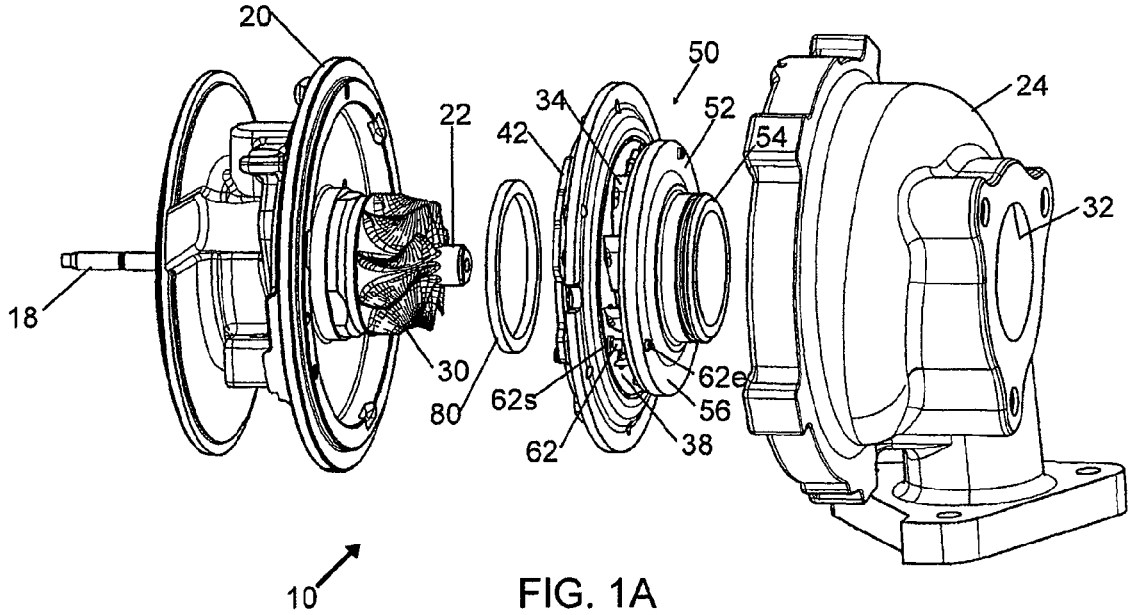
FIG. 1A is an exploded view from a first angle, showing a portion of a turbocharger having a variable-vane cartridge in accordance with one embodiment of the invention.
Figure 1B:
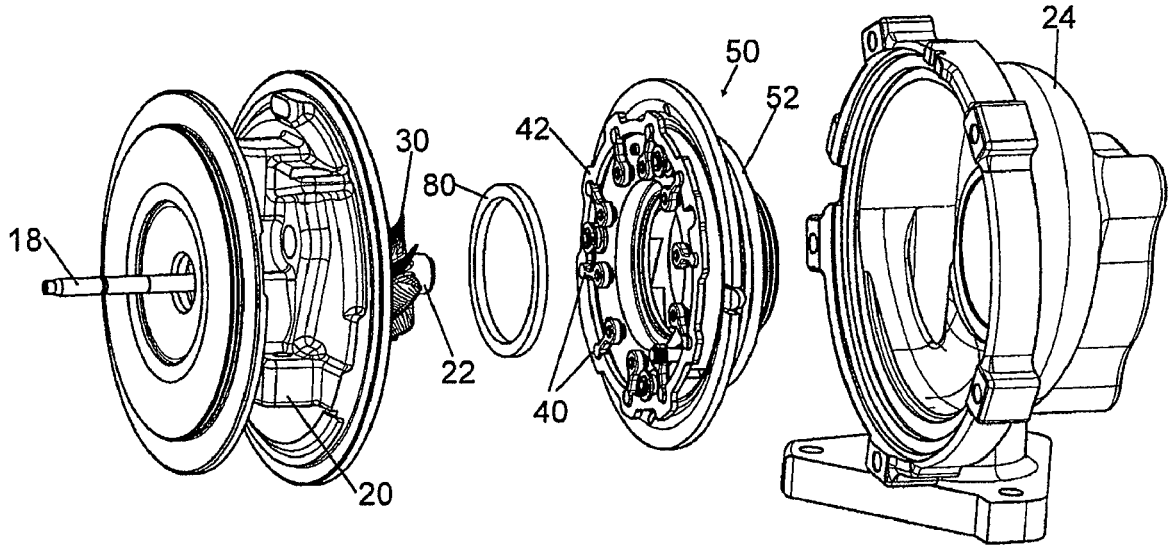
FIG. 1B is an exploded view of the turbocharger portion of FIG. 1A, from a second angle.
Figure 1C:
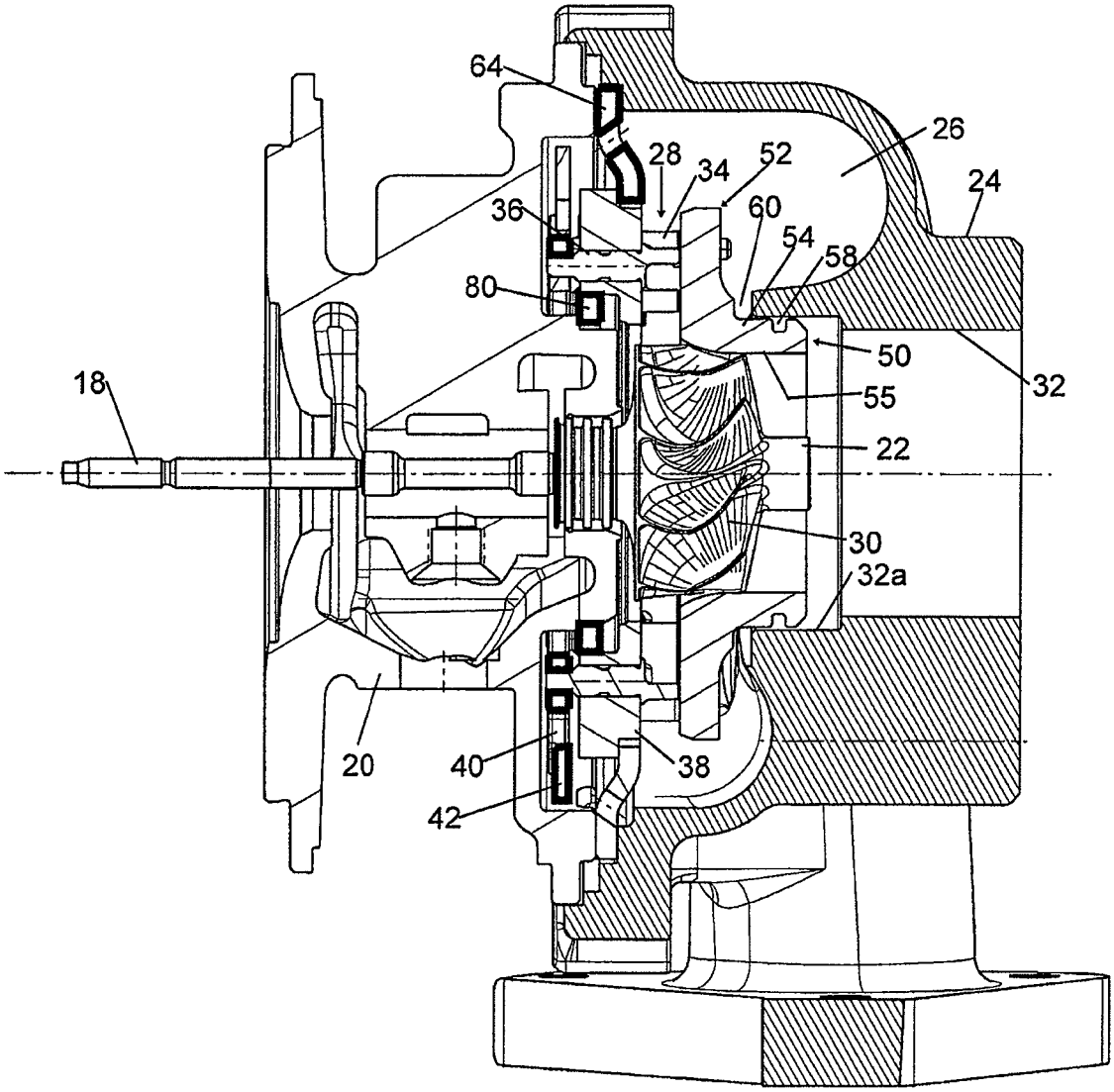
FIG. 1C is a cross-sectional view through the turbocharger portion of FIG. 1A.

One embodiment of a portion of a turbocharger 10 to which the method of the invention can be applied is illustrated in exploded perspective views in FIGS. 1A and 1B, and in cross-sectional view in FIG. 1C. The turbocharger portion is employed in a turbocharger that comprises a compressor having a compressor wheel or impeller mounted on one end of a rotatable shaft 18 and disposed in a compressor housing (the compressor portion of the turbocharger is omitted for clarity and ease of illustration). The shaft is supported in bearings (not specifically illustrated) mounted in a center housing 20 of the turbocharger. The shaft 18 is rotated by a turbine wheel 22 mounted on the other end of the shaft 18 from the compressor wheel, thereby rotatably driving the compressor wheel, which compresses air drawn in through the compressor inlet and delivers the compressed air to the intake of an internal combustion engine (not shown) for boosting the performance of the engine.

The turbocharger also includes a turbine housing 24 that houses the turbine wheel 22. The turbine housing defines a generally annular chamber 26 that surrounds the turbine wheel and that receives exhaust gas from the internal combustion engine for driving the turbine wheel. The exhaust gas is directed from the chamber 26 generally radially inwardly through a turbine nozzle 28 to the turbine wheel 22. As the exhaust gas flows through the passages between the blades 30 of the turbine wheel, the gas is expanded to a lower pressure, and the gas discharged from the wheel exits the turbine housing through a generally axial bore 32 therein.

The turbine nozzle 28 is a variable nozzle for varying the cross-sectional flow area and flow direction through the nozzle so as to regulate flow into the turbine wheel. The nozzle includes a plurality of vanes 34 that are circumferentially spaced about the nozzle. Each vane is affixed to a pin 36 that passes through an aperture in a generally annular nozzle ring 38 that is mounted coaxially with respect to the turbine wheel 22. Each pin 36 is rotatable about its axis for rotating the attached vane. The nozzle ring 38 forms one wall of the flow passage of the nozzle 28. Each of the pins 36 has a vane arm 40 affixed to an end of the pin that protrudes out from the nozzle ring 38, and is engaged by a generally annular unison ring 42 (also referred to herein as an actuator ring) that is rotatable about its axis and that is coaxial with the nozzle ring 38. An actuator (not shown) is connected to the unison ring 42 for rotating it about its axis. When the unison ring is rotated, the vane arms 40 are rotated to cause the pins 36 to rotate about their axes, thereby rotating the vanes 34 so as to vary the cross-sectional flow area and flow direction through the nozzle 28.

Figure 2:
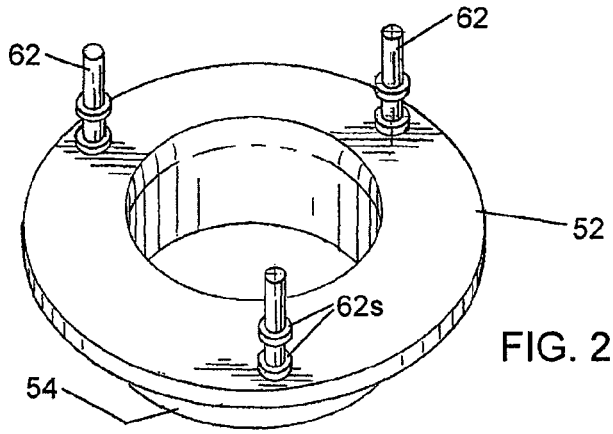
FIG. 2 is a perspective view of a subassembly of a variable vane cartridge for the turbocharger.

In the turbocharger 10, the variable vane mechanism is provided in the form of a cartridge 50 that is installable into and removable from the turbocharger as a unit. The cartridge 50 comprises the nozzle ring 38, vanes 34, pins 36, vane arms 40, and unison ring 42. The cartridge further comprises an insert 52 (shown in isolated perspective view in FIG. 2) that has a tubular portion 54 sealingly received into a portion 32*a* of the bore 32 of the turbine housing, and a nozzle portion 56 extending generally radially out from one end of the tubular portion 54, the nozzle portion 56 being axially spaced from the nozzle ring 38 such that the vanes 34 extend between the nozzle ring 38 and the nozzle portion 56. The bore portion 32*a* of the turbine housing has a radius that exceeds that of the remainder of the bore 32. The radially outer surface of the tubular portion 54 has one or more axially spaced circumferential grooves 58 as shown in FIG. 1, in each of which a sealing ring 59 (FIG. 3) is retained for sealingly engaging the inner surface of the bore portion 32*a*. Advantageously, the outer diameter of the tubular portion 54 of the insert is slightly less than the inner diameter of the bore portion 32*a* so that a slight gap is defined therebetween, and hence the inner surface of the bore portion 32*a* is contacted only the sealing ring(s). Additionally, there is a gap 60 between the nozzle portion 56 and the adjacent end of the turbine housing at the end of the bore portion 32*a*. In this manner, the insert 52 is mechanically and thermally decoupled from the turbine housing 24.

A plurality of spacers 62 are connected between the nozzle ring 38 and the nozzle portion 56 of the insert 52 for securing the nozzle ring to the insert and maintaining the desired axial spacing between the nozzle ring 38 and the nozzle portion 56. Each spacer 62 passes through a hole 112 (FIG. 3A) in the nozzle portion 56 and the distal end 62*e* of this end portion projects slightly beyond the outer face of the nozzle portion. A weld 62*h* is formed to affix the projecting end of the spacer to the nozzle portion 56. Each spacer also has a pair of enlarged shoulders 62*s* axially spaced along the length of the spacer such that one shoulder 62*s* abuts the inner face of the nozzle portion 56 and the other shoulder 62*s* abuts the opposite inner face of the nozzle ring 38, thereby setting the axial spacing between the nozzle ring and nozzle portion. An end portion of each spacer 62 passes through a hole 110 (FIG. 3A) in the nozzle ring 38 and the distal end 62*e* of this end portion projects slightly beyond the outer face of the nozzle ring. A weld 62*h* is formed to affix the projecting end of the spacer to the nozzle ring. Advantageously, the spacers 62 are formed of a material having good high-temperature mechanical properties and a relatively low thermal conductivity, such as stainless steel (e.g., grade 310 stainless steel) or the like, so that the nozzle ring 38 and insert 52 are effectively thermally decoupled from each other.

The variable-vane cartridge 50 also comprises a generally annular support ring 64 whose radially outer periphery is captured between the turbine housing 24 and the center housing 20 when these housings are bolted together. A radially inner periphery of the support ring 64 engages a surface of the nozzle ring 38 that faces toward the insert 52. The engagement between the support ring 64 and the nozzle ring 38 preferably is along a full 360° circumference of the nozzle ring so as to substantially seal the interface between the support ring and the nozzle ring. The support ring 64 also assists the spacers 62 in restraining the nozzle ring with respect to axial movement in the direction toward the insert 52. Advantageously, the support ring 64 has a radially inner surface facing toward a radially outer surface of the nozzle ring 38, and the support ring surface is slightly greater in diameter than the nozzle ring surface such that there is a radial gap between these surfaces. This gap accommodates radial displacement of the nozzle ring surface relative to the opposing support ring surface, such as may occur through differential thermal growth or other causes.

The cartridge 50 further comprises a locator ring 80 that is captively retained between the nozzle ring 38 and the center housing 20 when the cartridge is installed onto the center housing. The locator ring 80 has a radially inner surface that engages a radially outwardly facing surface of the center housing 20 so as to establish substantial concentricity between the center housing and locator ring. The radially outer surface of the locator ring 80 engages a radially inwardly facing locating surface 39 (FIG. 3) of the nozzle ring 38 so as to radially locate the nozzle ring substantially concentric with the locator ring, and therefore with the center housing. In this manner, the concentricity of the nozzle ring 38 with respect to the center housing (and therefore with respect to the turbine wheel 22) is established. Thus, as long as the insert 52 is substantially concentric with the nozzle ring 38, then the turbine flow path contour defined by the insert 52 will be substantially concentric with the turbine wheel, independent of the turbine housing 24.

The present invention is concerned with a method for achieving the desired substantially concentric relationship between the insert 52 and the nozzle ring 38. Specifically, it is desired for the radially inner surface 55 (FIG. 1C) of the tubular portion 54 of the insert 52 to be substantially concentric with the nozzle ring 38. Such concentricity could be achieved by machining the holes in the nozzle ring and insert for the spacers 62 with a high degree of dimensional and positional precision, and manufacturing the spacers 62 with a high degree of dimensional precision so they fit very closely within the holes. In practice, however, such high-precision machining is difficult and expensive to accomplish.

Figure 3:
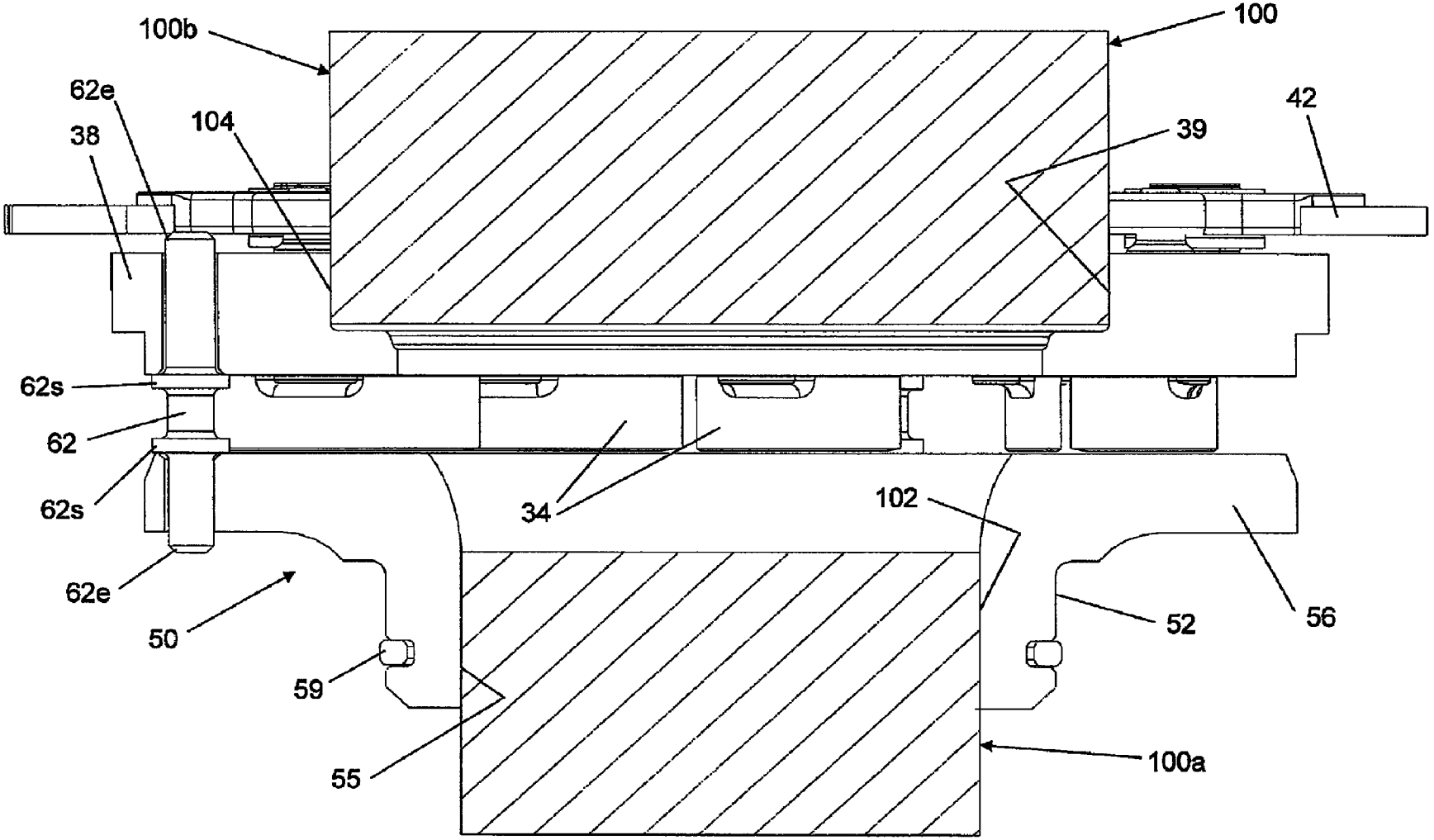
FIG. 3 is a cross-sectional view through a locating fixture in accordance with one embodiment of the invention, showing the assembly of the nozzle ring and insert mounted in the fixture to position them concentrically in preparation for a subsequent step of the assembly process.
Figure 3A:
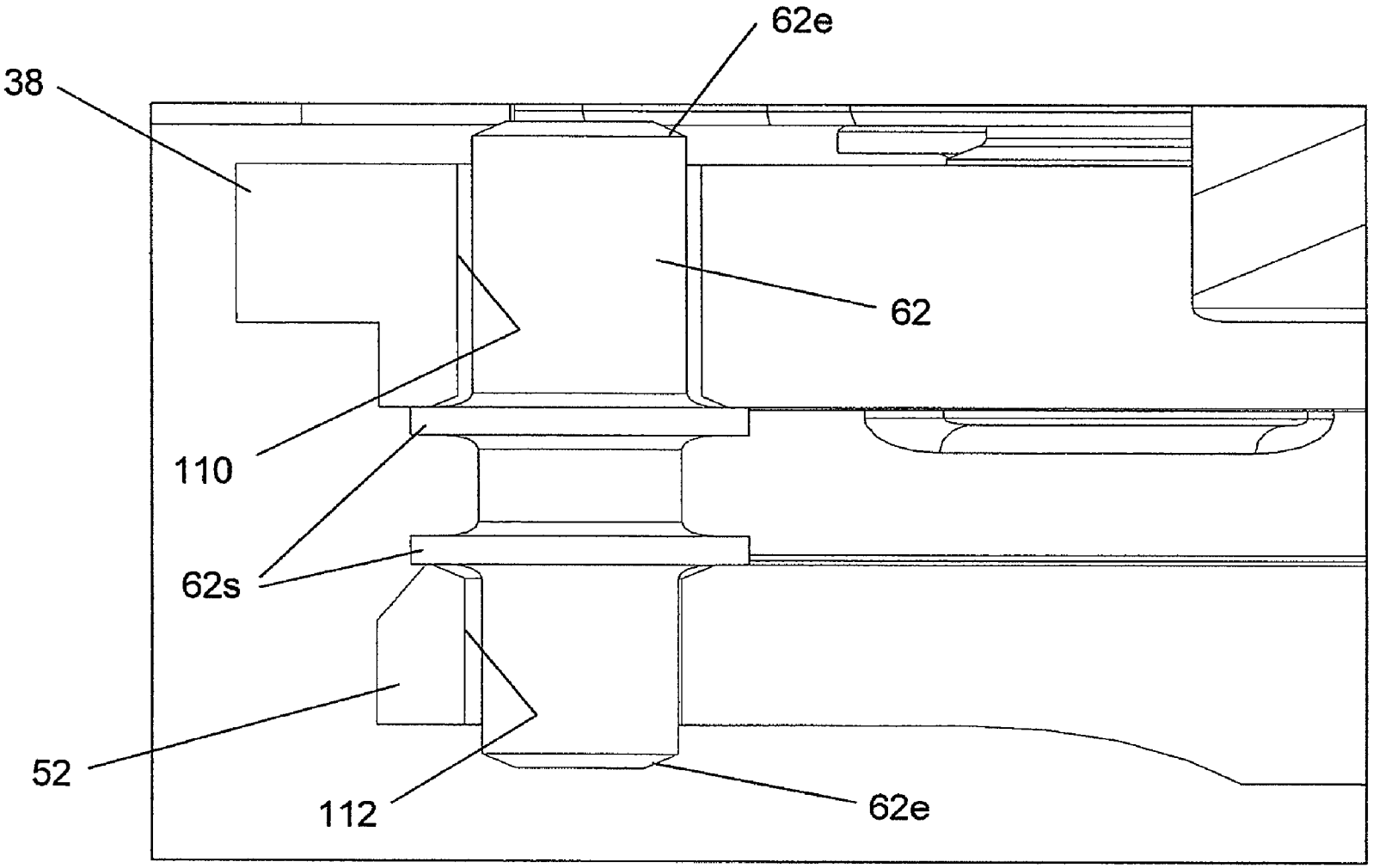
FIG. 3A shows a magnified portion of FIG. 3, to illustrate the large tolerances on component part manufacture made possible by the method.

In accordance with the present invention, an alternative manufacturing method is employed that allows the spacers 62 and corresponding holes in the nozzle ring 38 and insert 52 to be machined to a low precision. With reference to FIGS. 3 and 3A, the method employs a locating fixture 100 on which the cartridge assembly 50 comprising the nozzle ring 38, vanes 34, insert 52, and spacers 62 (and optionally the unison ring 42, as shown) is placed. The fixture 100 extends through the central openings of the nozzle ring 38 and insert 52. A first portion 100*a* of the fixture has a radially outer surface 102 that contacts the radially inner surface 55 of the insert 52. The surfaces 55 and 102 advantageously are circular cylindrical surfaces. A second portion 100*b* of the fixture, which is fixed in position with respect to the first portion 100*a*, has a radially outer surface 104 that contacts the locating surface 39 of the nozzle ring 38, and the surfaces 39 and 104 advantageously are circular cylindrical surfaces. The surfaces 102, 104 of the fixture are machined to be concentric with each other to a high degree of precision, and their diameters are machined to a high degree of precision so as to be only slightly smaller than the desired inside diameters of the corresponding surfaces 39, 55 of the nozzle ring and insert, respectively. The surface 39 of the nozzle ring is machined to a high degree of precision with respect to out-of-roundness and diameter so that the surface 39 engages the fixture surface 104 in a substantially line-to-line manner (i.e., with substantially no play therebetween). Likewise, the surface 55 of the insert is machined to a high degree of precision with respect to out-of-roundness and diameter so that the surface 55 engages the fixture surface 102 in a substantially line-to-line manner (i.e., with substantially no play therebetween).

Thus, when the fixture 100 is inserted into the cartridge assembly 50, the nozzle ring's locating surface 39 will be substantially concentric with the inner surface 55 of the insert, as shown in FIG. 3. At this point, the spacers 62 are still not affixed to the nozzle ring and insert. As best seen in FIG. 3A, the spacers 62 extend through holes 110 in the nozzle ring 38 and through holes 112 in the nozzle portion 56 of the insert 52. In accordance with the method of the present invention, the holes 110, 112 can be machined to a relatively low degree of precision as regards their diameters and the positions and orientations of their axes with respect to the center axis with which it is desired for the nozzle ring and insert to be concentric or coaxial. In particular, as shown in FIG. 3A, the diameters of the holes 110, 112 are machined to be significantly larger than the diameter of the portions of the spacers 62 received in the holes, and the tolerance on the hole diameter and position can be relatively large. The important requirements are that (1) the holes 110 in the nozzle ring 38 and the holes 112 in the insert 52 must be able to be aligned with each other and allow the spacers 62 to be inserted therein, (2) there must be sufficient play between the spacers 62 and the holes 110, 112 to allow the relative radial positions of the nozzle ring 38 and insert 50 to be established solely by the fixture 100, and (3) the holes 110, 112 must be smaller than the shoulders 62*s* formed on the spacers so that the shoulders will function properly to maintain the desired spacing between the nozzle ring and insert.

As illustrated in FIG. 3A, it is possible for any pair of holes 110, 112 that receive a given spacer 62 to be non-coaxial to a significant degree and to have diameters that differ appreciably. Thus, as shown, the hole 112 is significantly smaller in diameter than the corresponding hole 110, and the center of the hole 112 is displaced from the center of the hole 110 by a substantial amount. Without the use of the fixture 100, such large tolerances for the holes 110, 112 would result in poor concentricity between the nozzle ring and insert.

Figure 4:
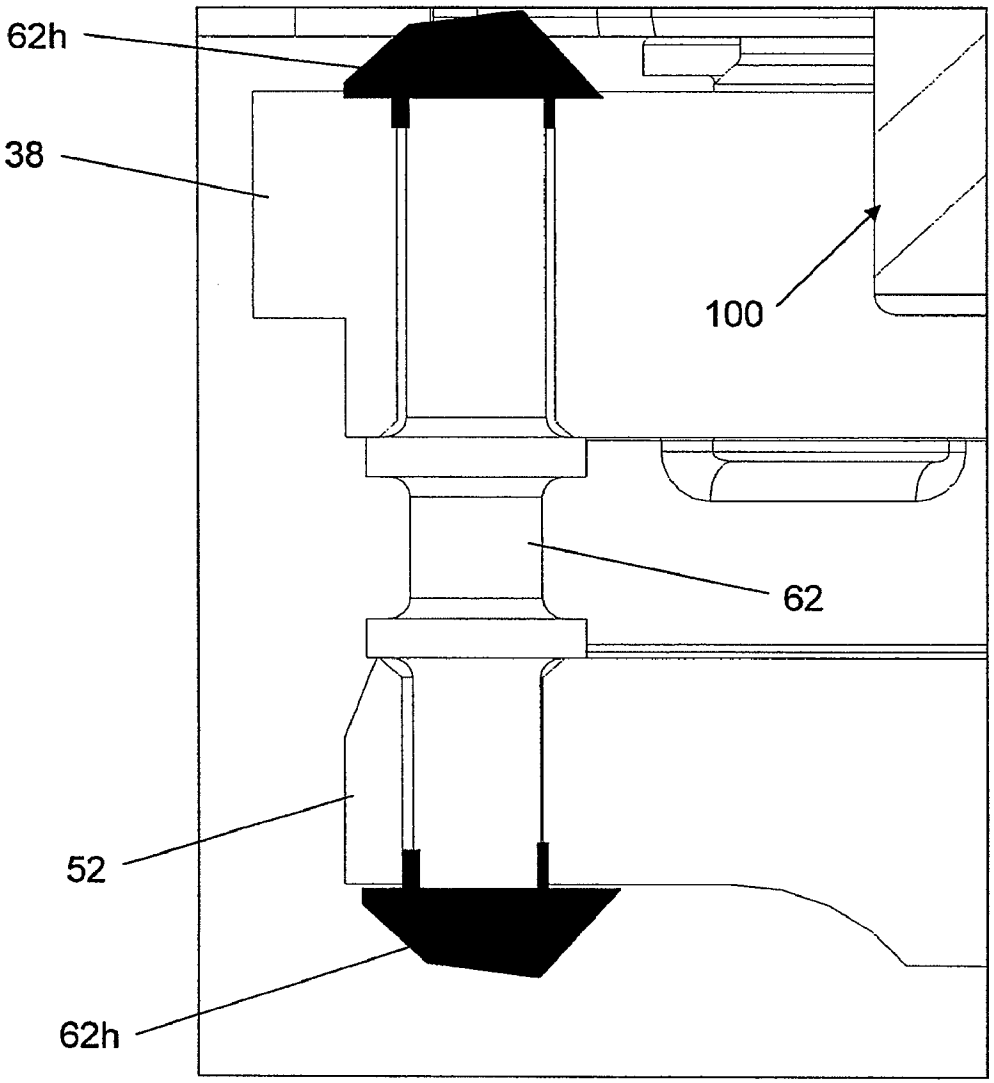
FIG. 4 is a view similar to FIG. 3A, showing the final step of the assembly process to fix the nozzle ring and insert in the substantially concentric relationship established by the locating fixture.

However, by using the fixture 100, concentricity between the nozzle ring and insert is established independently of the holes 110, 112, via engagement of the nozzle ring and insert with the surfaces 102, 104 of the fixture as previously described. Next, as shown in FIG. 4, with the desired concentric relationship established by the fixture, the nozzle ring and insert are fixed in that concentric relationship by affixing the spacers 62 to the nozzle ring and insert. Specifically, each spacer has ends 62*e* (FIG. 3A) that project slightly beyond the respective outer faces of the nozzle ring and insert. The spacers are affixed to the nozzle ring and insert by making welds 62*h* at the ends 62*e* of the spacers 62, so as to weld the ends 62*e* to the nozzle ring and insert. Suitable welding methods include but are not limited to laser welding, plasma welding, and electric (arc) welding. Once all of the spacers have been thus welded, the fixture 100 is removed from the cartridge assembly 50, and the assembly is ready to be prepared for installation in the turbocharger.

In the above-described embodiment, the fixture 100 establishes radial positioning between the nozzle ring 38 and the insert 52, but the axial positioning therebetween is established by the spacers 62, and specifically by the shoulders 62*s* (FIGS. 3 and 3A) on the spacers. In an alternative embodiment (not shown), the fixture can be configured to have surfaces for establishing the relative axial positioning between the nozzle ring and the insert, and accordingly the spacers can be simple cylindrical pins without shoulders. Once the spacers are welded to the nozzle ring and insert, the established axial positioning and radial positioning therebetween are fixed.

Figure 5:
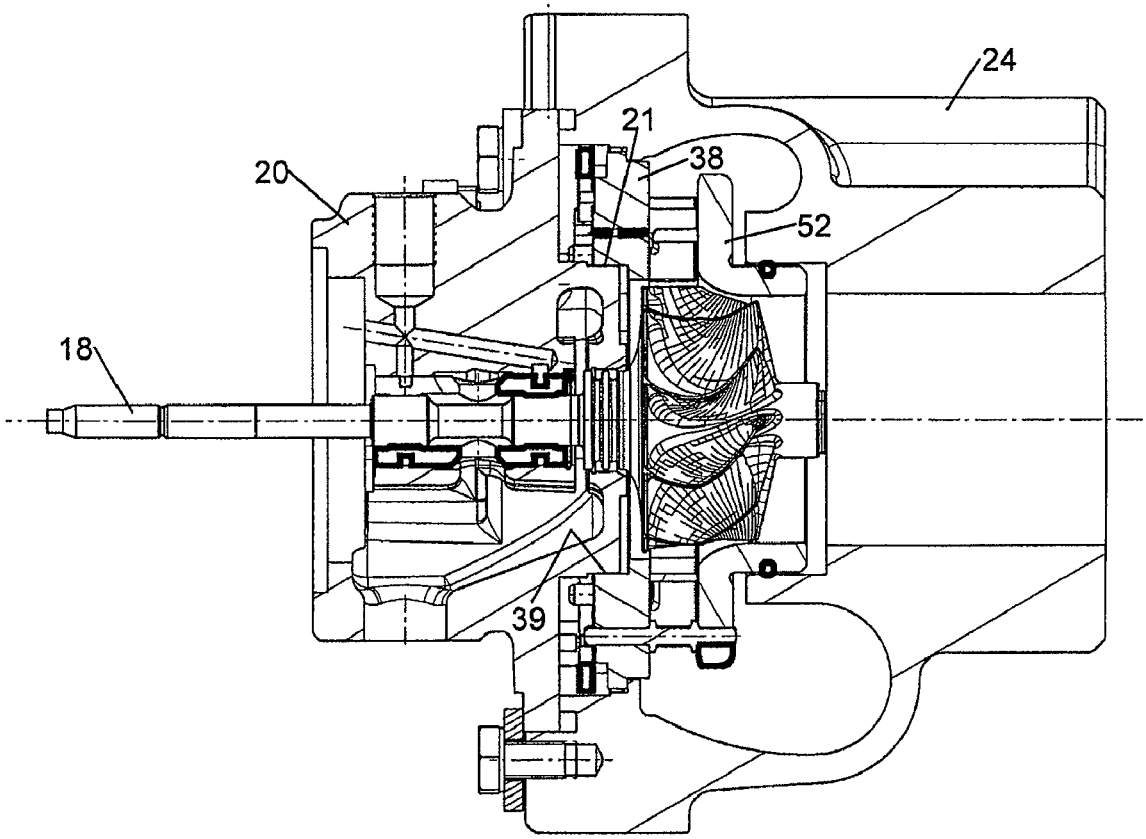
FIG. 5 is a cross-sectional view of a portion of a turbocharger in accordance with another embodiment.

With reference to FIG. 5, the method of the invention is also applicable to turbochargers with vane cartridges that are radially located with respect to the center housing without the use of the locator ring 80 of the previous embodiment. In the embodiment of FIG. 5, the nozzle ring 38 has its radially inner locating surface 39 directly contacting a locating surface 21 on the center housing so as to positions the nozzle ring substantially concentric with respect to the center housing. In other respects, the embodiment of FIG. 5 is generally similar to that of the first embodiment described above.

Many modifications and other embodiments of the inventions set forth herein will come to mind to one skilled in the art to which these inventions pertain having the benefit of the teachings presented in the foregoing descriptions and the associated drawings. For example, the method as shown and described above entails first assembling the nozzle ring 38 with the insert 52 using the spacers 62, and then engaging the resulting cartridge assembly with the locating fixture 100. Alternatively, however, it is possible to (1) engage one of the nozzle ring and insert with the fixture, then (2) insert the spacers into the holes in the part on the fixture, and then (3) insert the spacers into the holes in the other of the nozzle ring and insert while engaging the other part with the fixture; steps (1) and (2) may be reversed in order as well. Furthermore, various locating surfaces of various configurations and orientations can be provided on the nozzle ring and insert for engagement with the fixture. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method for manufacturing a variable-vane mechanism for a variable-geometry turbine of a turbocharger, comprising the steps of:

(a) providing components for a variable-vane cartridge including a generally annular nozzle ring for supporting an array of vanes circumferentially spaced about a central axis of the nozzle ring, an insert having a tubular portion for being sealingly received into a bore of a turbine housing and having a nozzle portion extending generally radially out from one end of the tubular portion, the insert having a central axis, and a plurality of spacers for extending between and connecting the nozzle portion of the insert and the nozzle ring;

(b) forming a plurality of circumferentially spaced first holes through the nozzle ring for respectively receiving first portions of the spacers, the first portions of the spacers fitting loosely in the first holes;

(c) forming a plurality of circumferentially spaced second holes through the nozzle portion of the insert for respectively receiving second portions of the spacers, the second portions of the spacers fitting loosely in the second holes;

(d) assembling the cartridge by inserting the spacers into the first and second holes;

(e) engaging the cartridge with a locating fixture to adjust relative radial positioning of the nozzle ring and the insert such that the center axes of the nozzle ring and the insert have a desired positional relationship, the spacers moving radially within the first and second holes as necessary to allow the relative radial positioning of the nozzle ring and insert to be established by the fixture; and (f) securing the spacers to the nozzle ring and the insert to fix the nozzle ring and the insert in the relative radial positioning established by the fixture.

2. The method of claim 1, wherein opposite ends of the spacers project beyond outer faces of the nozzle ring and the insert, and step (f) comprises welding the opposite ends of the spacers to said outer faces.

3. The method of claim 1, wherein step (e) comprises engaging a radially inwardly facing surface of the nozzle ring with a radially outwardly facing surface of the fixture.

4. The method of claim 1, wherein step (e) comprises engaging a radially inwardly facing surface of the insert with a radially outwardly facing surface of the fixture.

5. The method of claim 1, wherein step (e) comprises engaging a radially inwardly facing surface of the insert with a radially outwardly facing first surface of the fixture, and engaging a radially inwardly facing surface of the nozzle ring with a radially outwardly facing second surface of the fixture.

6. The method of claim 1, wherein step (d) is completed before step (e) is started.

7. The method of claim 1, wherein step (e) is at least partially performed before step (d) is completed.

8. The method of claim 1, wherein step (e) is at least partially performed before step (d) is started.

9. The method of claim 1, wherein each of the spacers has a first shoulder that is abutted by an inner face of the nozzle ring when the first portion of the spacer is received in one of the first holes, and a second shoulder that abuts an inner face of the nozzle portion when the second portion of the spacer is received in one of the second holes, the shoulders delimiting the axial spacing between the nozzle ring and the nozzle portion of the insert.

10. The method of claim 4, wherein the radially inwardly facing surface of the insert comprises an inner surface of the tubular portion of the insert.

11. A method for manufacturing a variable-vane cartridge for a variable-geometry turbine of a turbocharger, the cartridge including a generally annular nozzle ring for supporting an array of vanes circumferentially spaced about a central axis of the nozzle ring, an insert having a tubular portion for being sealingly received into a bore of a turbine housing and having a nozzle portion extending generally radially out from one end of the tubular portion, the insert having a central axis, and a plurality of spacers for extending between and connecting the nozzle portion of the insert and the nozzle ring, the nozzle ring having a plurality of circumferentially spaced first holes therethrough for respectively receiving first portions of the spacers, the nozzle portion of the insert having a plurality of circumferentially spaced second holes therethrough for respectively receiving second portions of the spacers, the method comprising the steps of:

(1) engaging a radial locating feature of the nozzle ring with a first surface of a locating fixture such that the nozzle ring is radially positioned in a predetermined position with respect to an axis of the fixture;

(2) inserting the first portions of the spacers respectively into the first holes;

(3) inserting the second portions of the spacers respectively into the second holes in the nozzle portion of the insert;

(4) engaging a radial locating feature of the insert with a second surface of the fixture such that the insert is radially positioned in a predetermined position with respect to the axis of the fixture; and (5) fixing the nozzle ring to the insert so as to preserve the relative radial positions thereof as established by the fixture.

12. The method of claim 11, wherein step (5) comprises affixing the spacers to the nozzle ring and the insert in a rigid fashion.

13. The method of claim 12, wherein step (5) comprises metallurgically bonding the spacers to the nozzle ring and the insert.

14. The method of claim 11, wherein at least one of steps (2) and (3) is completed before either of steps (1) and (4) is begun.

15. The method of claim 11, wherein at least one of steps (1) and (4) is completed before either of steps (2) and (3) is completed.

16. The method of claim 11, wherein step (4) is performed before step (1).

17. The method of claim 11, wherein steps (1) and (4) are performed substantially simultaneously, after steps (2) and (3) have been completed.

18. The method of claim 11, wherein step (1) is performed before step (4).

19. The method of claim 11, further comprising using the fixture to establish a relative axial positioning between the nozzle ring and the insert, and wherein step (5) comprises fixing the nozzle ring to the insert so as to preserve the relative radial and axial positions thereof as established by the fixture.

* * * * *